US007329841B2

(12) United States Patent
Verkade et al.

(10) Patent No.: US 7,329,841 B2
(45) Date of Patent: Feb. 12, 2008

(54) METHOD FOR OPERATING AN OVEN, AND AN ASSOCIATED DEVICE

(75) Inventors: Johannes Adrianus Maria Verkade, Rucphen (NL); Koen Jozef Van Niekerk, Eindhoven (NL)

(73) Assignee: Fri-Jado B.V. (NL)

( * ) Notice: Subject to any disclaimer, the term of this patent is extended or adjusted under 35 U.S.C. 154(b) by 0 days.

(21) Appl. No.: 11/344,047

(22) Filed: Feb. 1, 2006

(65) Prior Publication Data

US 2006/0190103 A1 Aug. 24, 2006

(30) Foreign Application Priority Data

Feb. 18, 2005 (NL) ..... 1028343

(51) Int. Cl.
*H05B 1/02* (2006.01)

(52) U.S. Cl. ..... 219/506; 219/497; 219/412; 219/494; 99/325

(58) Field of Classification Search ..... 219/412–415, 219/501, 497, 506, 494; 99/325–333
See application file for complete search history.

(56) References Cited

U.S. PATENT DOCUMENTS

| | | | | |
|---|---|---|---|---|
| 3,968,467 | A * | 7/1976 | Lampen et al. | 338/119 |
| 4,112,429 | A * | 9/1978 | Tsuha et al. | 345/156 |
| 4,121,204 | A | 10/1978 | Welch et al. | |
| 4,190,756 | A * | 2/1980 | Foerstner | 219/718 |
| 4,386,347 | A | 5/1983 | Cutler et al. | |
| 4,454,501 | A * | 6/1984 | Butts | 341/22 |
| 2003/0095096 | A1 | 5/2003 | Robbin et al. | |

FOREIGN PATENT DOCUMENTS

| | | | |
|---|---|---|---|
| DE | 196 45 907 | A1 | 5/1998 |
| DE | 10 2004 020 824 | A1 | 12/2005 |
| EP | 1 273 851 | A2 | 1/2003 |
| FR | 2 665 000 | A | 1/1992 |
| WO | WO 01/29483 | A1 | 4/2001 |
| WO | WO 03/077100 | A1 | 9/2003 |

OTHER PUBLICATIONS

European Search Report Dated Jun. 20, 2006.

* cited by examiner

*Primary Examiner*—Mark Paschall
(74) *Attorney, Agent, or Firm*—Michael Bednarek; Paul, Hastings, Janofsky & Walker LLP

(57) ABSTRACT

Method and control device for operating an oven. The control device comprises an operating panel which is substantially flat and sealed. One or more touch-sensitive regions of the panel define electronic on/off switches and an electronic rotary switch. Processing means connected to the rotary switch are suitable for detecting a property of a movement by a finger over at least a portion of a round path defined by the rotary switch. The property may be that of standstill, distance covered, speed and acceleration of the movement. The rotary switch provides the user with the possibility of running through selection options, shown on the display means, for recipes for the operation of the oven hygienically, quickly, easily and with a high resolution, of altering values for selection options and of monitoring the progress of the operation of the oven according to a selected recipe.

10 Claims, 2 Drawing Sheets

METHOD FOR OPERATING AN OVEN, AND AN ASSOCIATED DEVICE

BACKGROUND OF THE INVENTION

The invention relates to a method for operating an oven and to a device for carrying out the method in accordance with the preamble of claim 1 and claim 10, respectively.

FIELD OF THE INVENTION

In particular, the method and the device are intended for use in combination with a type of oven as used in shops for baking, frying, grilling, etc. dough products, such as bread, and meat, such as chickens, which have been placed onto spits which are driven in rotation individually and in groups. Ovens of this type are generally known. An operating panel of a control device for the known ovens has a number of switches, including rocker switches and rotary switches. The switches create an interface between a position or orientation of a hand or of one or more fingers of a user and electrical control inputs for the control device. The switches of the known ovens provide a mechanical transmission, i.e. different mechanical positions thereof correspond to associated electrical control signals for the control device. The user can enable the oven to operate according to a defined recipe as a function of the positions of the various switches.

The known method and control device have the drawback that the mechanical switches have a limited number of positions, which restricts the number and complexity of recipes. Another drawback is that the mechanical switches can easily become dirty in the environment in which they are used, even if the user's fingers are clean, which can lead to the occurrence of sources of germs and therefore to unhygienic situations. Further drawbacks are that the mechanical switches take up a large amount of space, are difficult to connect to terminals of the control device and are susceptible to wear and require maintenance. In addition, mechanical switches, in particular rotary switches, have projecting operating parts which are susceptible to damage. Furthermore, it is difficult to determine from the positions of the various switches what recipe has been set and what positions the user needs to put the switches in in order to set a desired recipe.

SUMMARY OF THE INVENTION

It is an object of the invention to eliminate the above-mentioned drawbacks, in particular those of using rotary switches.

This object is achieved by the provision of a method according to claim 1. The objective is also achieved by the provision of a control device according to claim 10.

Since the touch-sensitive region of the operating panel which a user employs to effect the settings is flat and continuous, residual dirt in that region and the resultant occurrence of germs is counteracted to a considerable extent. A movement over the touch-sensitive region can extend over part or all of a circular path. As a result, a combination of the touch-sensitive region and means for sensing the region to detect the movement and for processing signals thereby obtained can be referred to as a functionally simulated rotary switch, in particular an electronic rotary switch.

A parameter for which the user wishes to set a value may be a physical variable, such as a temperature. However, the method and device according to the invention also enable the parameter to be a non-physical variable, such as a recipe number or a page number of a recipe written on a number of virtual pages. As a result, the simulated rotary switch can be used multifunctionally, which increases the use options for the switch and thereby those of the oven considerably.

The movement may extend over a plurality of circuits of the path. As a result, it is possible to alter the value of a parameter over a wide range using small steps for the value but in accordance with relatively large distances covered by the movement. This facilitates the implementation of precision setting. The setting of a desired recipe, in particular a new recipe, is not restricted by a limited number of positions of a mechanical rotary switch. Permitting the distance to cover more than one circuit also makes it possible to alter the alteration of the value of the parameter less critically than if the distance covered for the same range of values amounts to at most one circuit, depending on the speed of the movement. In addition, a distance covered of longer than one circuit allows a nonlinear relationship between the distance covered by the movement and the change in value to be implemented more successfully than if the distance covered for the same range of values is at most one circuit, and in particular enables the parameter value to be changed more quickly when the distance covered increases, irrespective of the influence of the speed of the finger on the change in value. Conversely, this means that the shorter the distance covered from a starting point, the easier it is to precisely set the parameter value.

BRIEF DESCRIPTION OF THE DRAWINGS

Other properties and advantages of the method and of the control device according to the invention will become clear from the following explanation of an embodiment of a control device according to the invention with reference to the appended drawing. In the drawing.

DESCRIPTION OF THE PREFERRED EMBODIMENT

Figure 1:
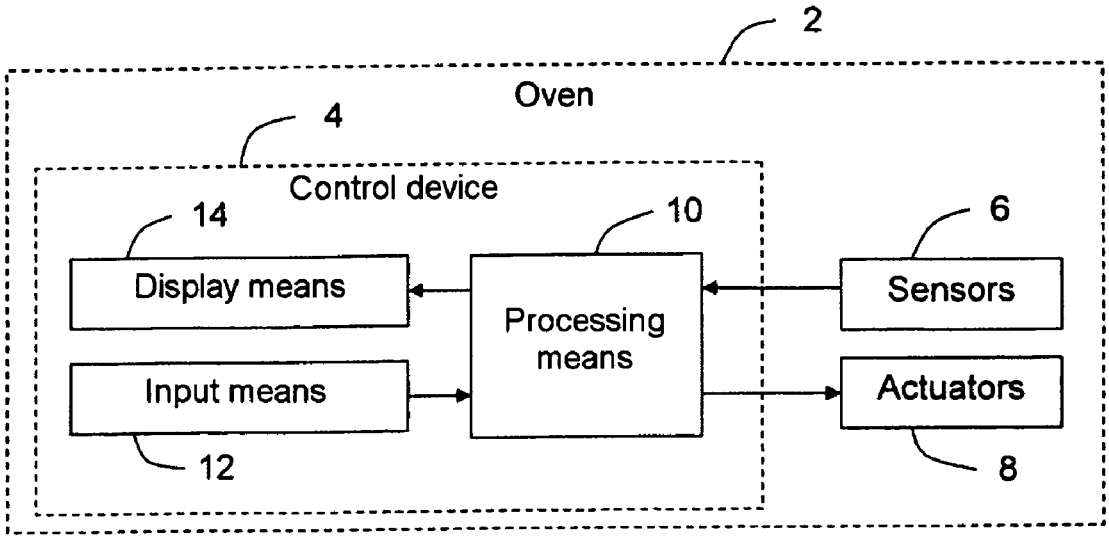
FIG. 1 shows a block diagram of an oven, at the level of setting parameters of recipes and processing them.

FIG. 1 diagrammatically depicts an oven 2 at control level. The oven comprises a control device 4. The control device 4 is connected to sensors 6 to receive measurement signals from them, for example relating to the temperature at a specific physical location inside the oven. The control device 4 is also connected to actuators 8, such as heating elements and displacement means.

The control device 4 comprises processing means 10, input means 12 and output means, which are in particular visual display means 14. The processing means 10 are connected to the sensors 6, the actuators 8, the input means 12 and the display means 14. By means of the input means 12, a user can provide instructions, such as a desired recipe, a desired temperature and a time profile, to the processing means 10. The processing means 10 comprise an electronic computer unit, which controls the operation of the oven according to a specific program and as a function of instructions provided by the user and of measurement signals supplied by the sensors 6.

Figure 2:
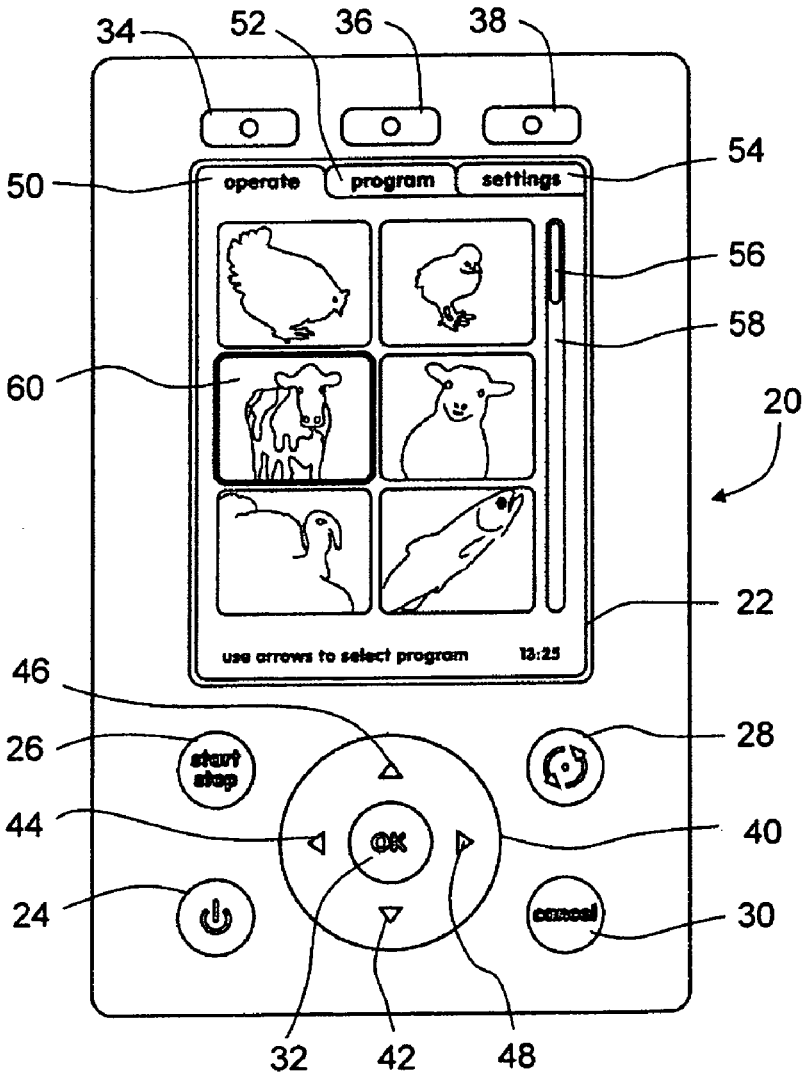
FIG. 2 shows a front view of an example of an operating panel of an embodiment of the control device according to the invention.

FIG. 2 shows a front view of an operating panel 20 of the control device 4. The operating panel 20 comprises at least the portion of the input means 12 and of the display means 14 which the user requires to input instructions and to look at settings and measured values. Accordingly, the panel 20 comprises a number of electronic switches and a display screen 22. The panel 20 is substantially flat and continuous. By way of example, the panel 20 comprises an outermost covering which is formed by a transparent glass pane or a plastic layer. Furthermore, the panel 20 adjoins a housing of the control device 4 or of the oven 2 in a sealed way. These measures counteract the possibility of undesired material, such as grease from the user's fingers, breadcrumbs and pieces of meat, accumulating on the panel 20 and of an unhygienic source of germs thereby being formed.

The electronic switches are touch-sensitive switches, such as capacitive, resistive or piezo switches. According to the example shown, the switches comprise on/off switches 24 to 38 and a simulated rotary switch 40.

The switch 24 is used to switch the oven 2 on/off. The switch 26 is used to start/interrupt/continue the operation of the oven 2. The switch 28 is used to operate drive means of a spit-roasting device in the oven 2. The switch 30 is used to cancel an earlier selection. The switch 32 is used to confirm a selection which has been made. The switches 34, 36, and 38 are used to choose an associated virtual page which comprises settings and/or measured values and is shown on the display screen 22.

The rotary switch 40 comprises switching elements arranged along a circuit (in this case circular) path around the switch 32. Arrow symbols 42, 44, 46 and 48 are printed on this path in the four directions of the compass. If the user moves a finger along the said path, this is sensed by the input means 12 and detection signals obtained in this way are processed by the processing means 10 to give a value for a specific parameter. The processing means 10 are preferably suitable for measuring a standstill position, in particular on each of the arrow symbols 42-48, by the finger, the distance covered by the movement, the speed of the movement and the acceleration of the movement and for linking a value of the parameter to the measured value obtained. As a result, the user can quickly scroll through various setting positions of a page shown by the screen 22, can quickly set a different value for a parameter and can easily change the value with a high resolution.

Figure 3:
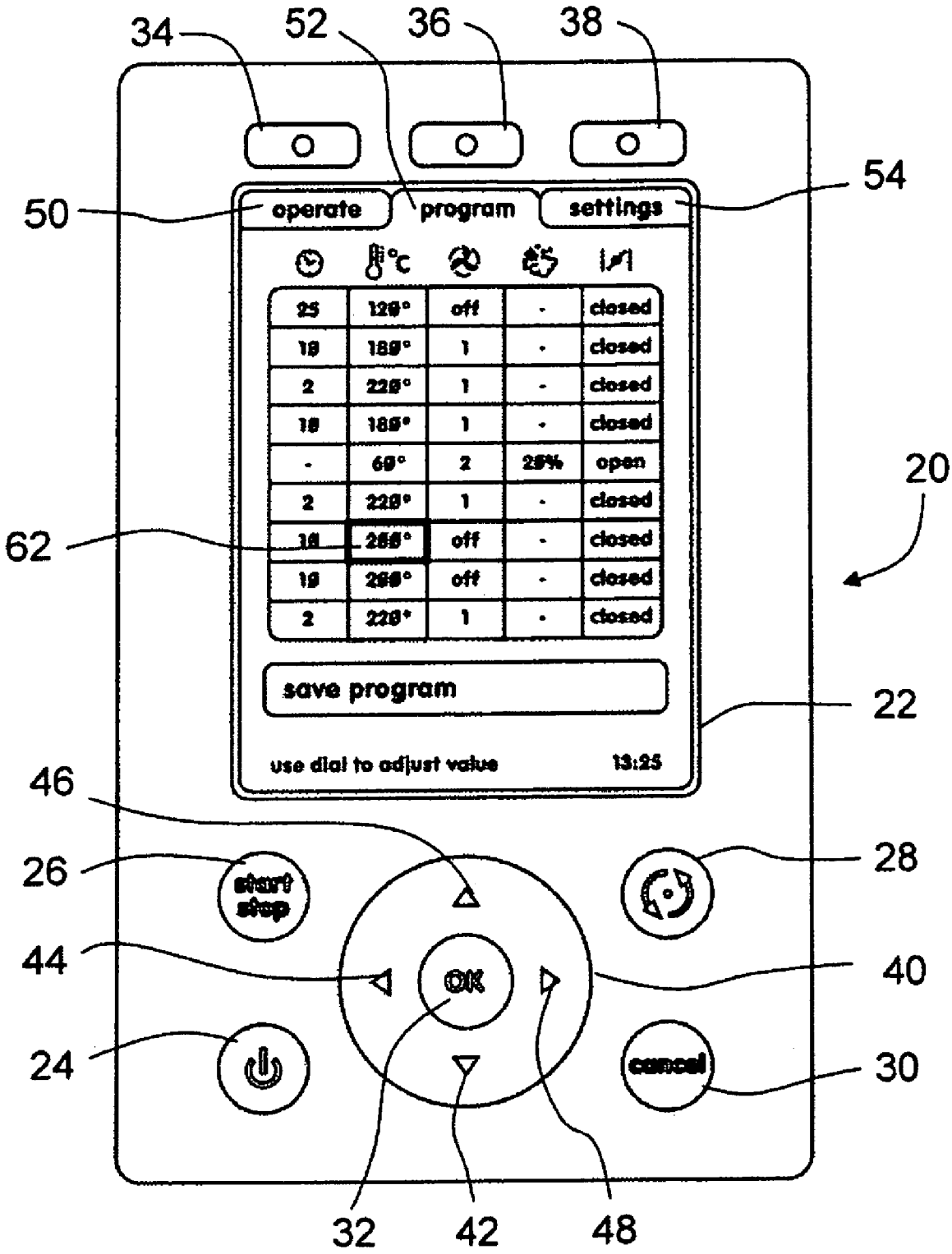
FIG. 3 shows a view of the operating panel from FIG. 2 in a different state of the control device from that shown in FIG. 2.

In the example of FIG. 2, the display screen 22 shows a first page with a tab 50 out of three possible pages. This page is selected by pressing on the switch 34. If the switch 36 is pressed, the display screen 22 will show a second page with a tab 52. This is illustrated in FIG. 3. If the switch 38 is pressed, the display screen 22 will show a third page with a tab 54.

By using the rotary switch 40, in particular by pressing on the arrow symbols 44-48, the user can control the processing means 10 in order to scroll through various selection options on a page which is shown. If the screen 22 cannot show all the selection options of a page simultaneously, this is indicated by a slider 56 on a scroll bar 58. As the user runs through the various selection options on a page, a selection option is highlighted, for example by means of an additional border of a first colour, as shown in FIG. 2 for a selection field 60 bearing the symbol of a cow and in FIG. 3 for a selection field 62 for a temperature value. By pressing the switch 32, the selection option which is highlighted is actually selected. This can be indicated by showing the abovementioned border in a second colour.

The electronic rotary switch 40 enables a range of a values for a parameter to be set using the rotary switch 40 to be covered by any desired number of (complete or incomplete) circuits of the rotary switch 40. The range of values for the parameter can then be spread over a longer distance. As a result, it is easier for the user to set a value with a high resolution. Moreover, as used in a preferred embodiment of the invention, the abovementioned spreading can be made nonlinear, in such a manner that the parameter value is altered to a greater or lesser extent per unit distance length covered as the distance from a starting point covered by the finger increases or decreases. The electronic implementation of the rotary switch 40 enables different nonlinear relationships between the distance covered and the speed of change of the parameter value to be used for different parameters. This is favourable with a view to improving the ease of use and simplifying the design (just a single rotary switch for a plurality of parameters). As a result, the possible applications of the control device 4 and therefore of the oven 2 increase, which is very favourable for the cost price.

As will have become clear from the above, the invention provides a method and a control device allowing a user to pass through, reset and alter various recipes in a very hygienic way and very easily, finely and quickly and to follow the progress of the operation of the oven 2 according to a selected recipe.

What is claimed is:

1. Method for operating an oven, comprising a user inputting a value for at least one parameter of a recipe, according to which a control device of the oven can control the operation of the oven, into the control device via an operating panel of the control device, wherein the value can be input by the user moving a finger along at least a portion of a circuit path within a defined, flat, continuous region of the outer surface of the operating panel, the occurrence of such a movement is monitored, wherein at least one property of such a movement is measured when the movement is detected, wherein the value of the parameter of the recipe is altered in accordance with a measured value for the property of the movement, and wherein at least one of the distance covered by the movement, the speed of the movement and the acceleration of the movement is measured as said property of the movement, and wherein the control device is configured to measure the property of a movement that extends over more than one complete circuit path.

2. Method according to a claim 1, wherein a range of values for the parameter from a starting point of the movement is distributed non-linearly over a defined distance which can be covered by the movement.

3. Method according to claim 2, wherein the density of settable values for the parameter per unit distance length is increased as the parameter moves further from the starting point.

4. Method according to claim 1, wherein the finger being placed in a specific location, out of one or more specific locations on the circuit path, on the panel is processed as a property, the occurrence of which is monitored and on detection of which the value of the parameter is altered in accordance with the location where the finger has been placed.

5. Method according to claim 1, wherein in the event of the parameter being altered, as a result of an alteration in a condition of a monitored property being detected, a visual display corresponding to the alteration is altered.

6. Method according to claim 5, wherein the display presents at least one step of the recipe.

7. Oven comprising a control device for controlling operation of the oven in accordance with a recipe, comprising an operating panel for a user to input a value of at least one parameter of the recipe, wherein the operating panel has a flat, continuous touch-sensitive region, sensing means for monitoring the touch-sensitive region being touched and for accordingly supplying at least one detection signal, processing means for receiving the detection signal, for deriving the occurrence of an at least partially circuit movement of a touch on the touch-sensitive region of the panel from the detection signal, wherein the processing means are configured to measure at least one property of the movement on detection of the occurrence of the movement and for altering the value of the parameter of the recipe in accordance with a measured value for the property of the movement, the property of the movement being at least one of the distance covered by the movement, the speed of the movement, and the acceleration of the movement, and wherein the processing means are configured to measure the property of a movement that extends over more than one complete circuit of the touch-sensitive region.

8. Oven according to claim 7, wherein a display screen is provided for displaying the alteration to the value of the parameter of the recipe.

9. Oven according to claim 7, wherein the touch-sensitive region of the operating panel comprises a center region and a strip around the center region, the processing means deriving the occurrence of the at least partially circuit movement from the detection of a movement along the strip, and the processing means processing a detected touching of the center region as a switching event.

10. Oven according to claim 7, wherein the touch-sensitive region of the operating panel comprises capacitive means for detecting a user's finger touching the touch-sensitive surface.

* * * * *